US005794955A

United States Patent [19]

Flynn

[11] Patent Number: 5,794,955

[45] Date of Patent: Aug. 18, 1998

[54] MOUNTAIN BOARD

[76] Inventor: Raymond G. Flynn, 1902 Wharton Rd., Jenkintown, Pa. 19046

[21] Appl. No.: 673,820

[22] Filed: Jun. 27, 1996

Related U.S. Application Data

[60] Provisional application No. 60/001,571 Jul. 27, 1995.

[51] Int. Cl.[6] ..... B62M 1/00

[52] U.S. Cl. ..... 280/87.042; 280/11.28

[58] Field of Search ..... 280/87.042, 11.28, 280/87.041, 11.19

[56] References Cited

U.S. PATENT DOCUMENTS

| | | | |
|---|---|---|---|
| 1,070,468 | 8/1913 | Henley | 280/87.042 |
| 2,494,019 | 1/1950 | Ware, Jr. . | |
| 2,537,213 | 1/1951 | De Vault . | |
| 3,252,713 | 5/1966 | Heller . | |
| 4,060,253 | 11/1977 | Oldendorf | 280/87.04 |
| 4,089,536 | 5/1978 | Larrucea | 280/11.28 |
| 4,133,546 | 1/1979 | Rosenblum | 280/11.1 BT |
| 4,152,001 | 5/1979 | Christianson | 280/11.28 |
| 4,200,302 | 4/1980 | de Rosnay | 280/1 |
| 4,955,626 | 9/1990 | Smith et al. | 280/87.042 |
| 4,991,861 | 2/1991 | Carn et al. | 280/87.092 |
| 5,048,632 | 9/1991 | Battel | 180/181 |
| 5,114,166 | 5/1992 | McCosker | 280/87.042 |
| 5,160,155 | 11/1992 | Barachet | 280/87.042 |
| 5,169,166 | 12/1992 | Brooks | 280/87.042 |
| 5,232,235 | 8/1993 | Brooks | 280/87.042 |
| 5,263,725 | 11/1993 | Gesmer et al. | 280/11.28 |
| 5,330,214 | 7/1994 | Brooks et al. | 280/84.042 |
| 5,507,513 | 4/1996 | Peters et al. | 280/250.1 |

FOREIGN PATENT DOCUMENTS

| | | | |
|---|---|---|---|
| 2607713 | 6/1988 | France | 280/87.042 |
| WO 94/23810 | 10/1994 | WIPO | A63C 17/02 |

*Primary Examiner*—Peter M. Poon
*Attorney, Agent, or Firm*—Synnestvedt & Lechner

[57] ABSTRACT

A steerable wheeled riding board for use on rough or irregular terrain having an elongated platform with a planar surface for supporting a rider of the board. Large diameter wide track wheels having pneumatic tires are mounted which steer in response and in proportion to the rider shifting his weight and tilting the platform. Steering is afforded via a steering plate engaging an axle plate attached to a wheel set, the steering plate having an adjustable angular orientation to adjust steering sensitivity. Quick and easy assembly and disassembly of the riding board is afforded by split collar attachment fittings with allen screw compression clamping.

22 Claims, 9 Drawing Sheets

MOUNTAIN BOARD

RELATED APPLICATIONS

This application is based on and claims the benefit of prior filed co-pending provisional application Ser. No. 60/001,571, filed Jul. 27, 1995.

FIELD OF THE INVENTION

This invention relates to steerable wheeled boards for sport or recreational use particularly suited to travel over relatively irregular terrain.

BACKGROUND OF THE INVENTION

Steerable wheeled boards such as skateboards are widely used for sport, recreation and transportation. Generally, skateboards are steered by means of the rider shifting his weight and causing the skateboard platform to tilt. Steering forces are imparted to wheel sets, typically arranged at opposite ends of the skateboard, in response and in proportion to the tilting action of the platform supporting the rider.

Traditionally, skateboard wheel sets have had rather wide, small diameter, solid wheels rotating on low friction ball bearings on stub axles mounted beneath the board on trucks comprising the steering mechanism responsive to skateboard tilt. Such skateboards are limited for use exclusively on smooth hard surfaces such as cement or asphalt. The small diameter wheels tend to bog down on soft ground, solid wheels provide no shock absorption against jarring bumps, and the extremely narrow track and short wheelbase of the skateboard combined with a low ground clearance make travel over anything but a smooth hard surface virtually impossible.

SUMMARY AND OBJECT OF THE INVENTION

This invention provides a steerable, wheeled riding board suitable for travel over relatively rough terrain.

A preferred embodiment of the board has large diameter wheels which will not bog down on soft ground and further provide adequate ground clearance for the board when traveling over rough terrain, even when the board is tilted to effect steering. The wheels preferably mount pneumatic tires which provide a shock absorbing function against bumps, ruts and other irregularities of the terrain.

Although under some circumstances, a single wheel can comprise a wheel set, preferably, two wheels are mounted on a relatively long axle forming a wide tracked wheel set, and two wheel sets are preferably mounted at opposite ends of an elongated platform having a planar support surface which supports the rider of the mountain board. The axles are oriented transversely to the long axis of the platform, and the platform is preferably suspended beneath the axles to provide stability to the board. The wide track and long wheelbase provide further stability and maneuverability to the board on sloping, irregular ground.

Preferably, both front and rear wheel sets are steerable, and steering forces are imparted to each wheel set in response and in proportion to the rider shifting his weight and tilting the elongated platform. Steering forces are effected by steering mechanisms associated with each wheel set, each steering mechanism comprising a steering plate mounted at each end of the platform. Each steering plate has a horizontally extending axis extending perpendicularly to the long axis of the platform and parallel to the planar support surface of the platform. Each steering plate is further preferably disposed about its respective horizontally extending axis at an angular orientation other than 90° relative to the long axis of the platform.

Preferably, the steering plates extend upwardly from the platform. Pivoting means project perpendicularly from the surface of each steering plate. Each pivoting means is preferably a bolt which pivotally attaches each steering plate to a respective axle plate. The axle plates are parallel to and overlap their respective steering plates and each is capable of pivotal movement in a plane parallel to its respective steering plate. The axle plates are fixed to and extend parallel to each respective axle. Preferably, each axle plate extends downwardly from its respective axle to its pivotal mounting on its respective steering plate. This results in the platform being suspended beneath the axles on the pivoting means, thereby providing inherent stability to the board.

When the platform is tilted about its long axis on the pivoting means each steering plate pivots relatively to a respective axle plate imparting steering forces causing each axle to turn. The sensitivity of the steering, being dependent on the proportionality between the angle of platform tilt and the angle through which the axles turn in response thereto, is controlled by the angular orientation of each steering plate relatively to the long axis of the platform. It is therefore possible by adjusting the steering plate angle to have only one wheel set steer or one wheel set steer proportionally more than the other in response to platform tilt. It is further possible to have each wheel set steer in an opposite direction in response to platform tilt. In a preferred embodiment of the invention however, the steering plate angles are such that each wheel set steers in the direction of platform tilt in the same proportion to the degree of platform tilt.

As steering sensitivity is controlled by the angular orientation of the steering plates, it is desirable in a preferred embodiment of the invention to provide means for adjusting the steering plate angular orientation.

In a preferred embodiment, the adjusting means comprises a respective rotational means for mounting each steering plate on the platform which allows each steering plate to rotate about its respective horizontally extending axis relatively to the platform. The adjusting means further comprises respective stop means for limiting the angular rotation of each steering plate on the rotational means to a desired angle, thereby adjusting each steering plate's angular orientation.

In an alternative embodiment, the adjusting means again comprises respective rotational means for mounting each steering plate on the platform, allowing each steering plate to rotate about its respective horizontally extending axis, but further includes respective means for imparting a predetermined rotational displacement to each steering plate. The rotational displacement imparting means is presettable to limit the rotation of the steering plate to the desired angle relative to the platform.

The mountain board is designed to be rapidly and easily assembled and disassembled for convenient transportation as, for example, in an automobile trunk and for storage. The wheel sets and steering mechanisms are therefore quickly removable from the platform as a unit, and the wheels themselves can be mounted and demounted from the axles with simple hand tools.

In a preferred embodiment of a wheel mounting, a wheel is mounted on a wheel retaining shaft which is coaxially arranged in a recess in the end of an axle. A cylindrical annular bushing of compressible, resilient material is also coaxially arranged in the recess. The shaft extends through the center hole of the annular bushing and is retained within the bushing preferably by a compression plate. The outer surface of the bushing contacts the inner surface of the recess. When the retaining shaft is tightened the bushing is axially compressed between the compression plate and the wheel, causing the bushing to expand outwardly, thereby exerting pressure on the axle recess and developing frictional forces between the bushing and the axle to retain the wheel to the axle.

In an alternative embodiment of the wheel mounting, a wheel retaining shaft is again coaxially arranged in a recess at the end of an axle. A cylindrical annular bushing of relatively incompressible material is positioned coaxially within the recess, the shaft extending through the center hole of the bushing and retained by a nut. The bushing is cut lengthwise at an angle forming two wedge shaped bushing halves which engage each other on their inclined surfaces. Tightening the retaining shaft compresses the bushing halves against the wheel causing each bushing half to ride up the inclined surface of the mating half. The bushing halves are thus forced to expand outwardly by the wedging action and develop frictional forces between the outer surface of the bushing and the inner surface of the recess, the frictional forces retaining the wheel to the axle.

It is an object of this invention to provide a steerable wheeled riding board capable of supporting a rider while traversing rough or irregular terrain.

It is an object of this invention to provide a steerable wheeled riding board which can be easily and rapidly assembled and disassembled.

It is a further object of this invention to provide a wheeled riding board steerable by a rider in response to the rider shifting his weight.

Another object of the invention is to provide a wheeled riding board for sport or recreation use having a wide track for stability and maneuverability over irregular terrain, the riding board also having large diameter wheels for adequate ground clearance and pneumatic tires to absorb the shocks normally experienced by wheeled vehicles while traversing rough terrain.

These and other objects will become apparent from a consideration of the following drawings and detailed description of preferred embodiments of the invention.

DETAILED DESCRIPTION OF THE PREFERRED EMBODIMENTS

Figure 1:
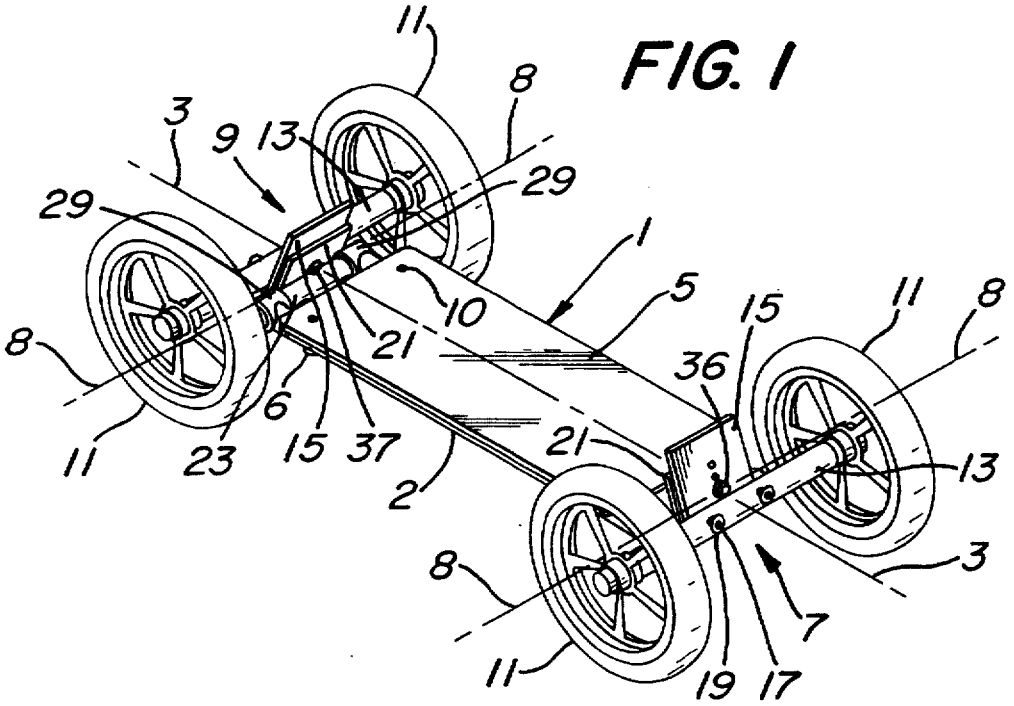
FIG. 1 shows an isometric view of a preferred embodiment of the mountain board.

FIGS. 1–7 show an embodiment of a mountain board according to the invention. FIG. 1 shows an elongated platform 1 having long axis 3 and preferably supported on longitudinal tubes 2 and having a planar support surface 5 for support of a rider. Support surface 5 is preferably attached to longitudinal tubes 2 by nuts 4 and bolts 10 and fittings 6.

Figure 7:
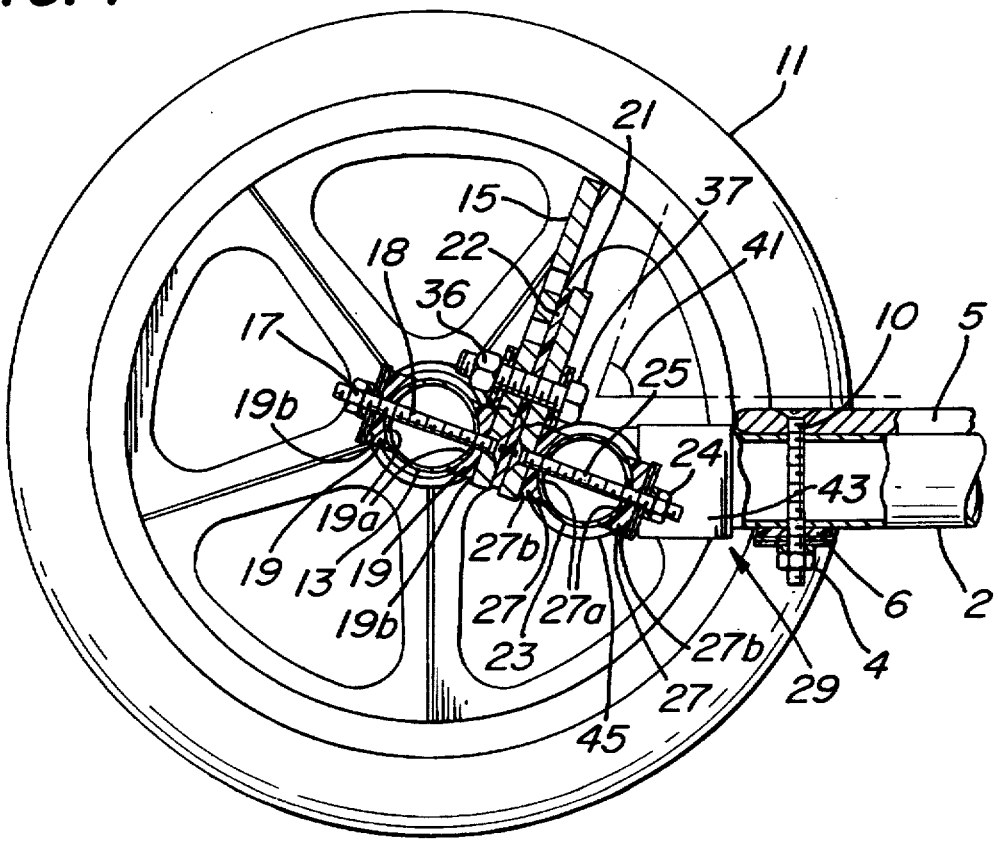
FIG. 7 is a sectional detail on the same scale as FIGS. 4 and 5 taken along line 7—7 of FIG. 2 showing details of the steering means.
Figure 8:
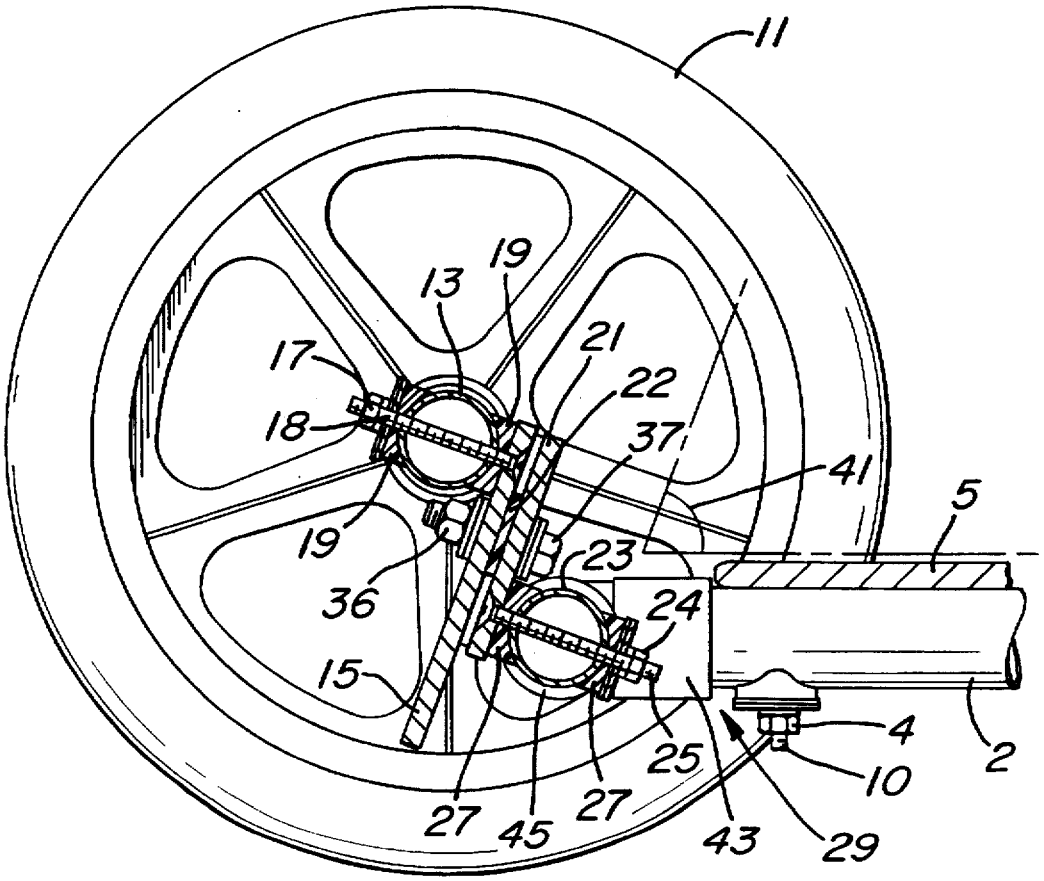
FIG. 8 is a sectional detail on the same scale as FIGS. 4 and 5 showing a preferred embodiment of the steering means and steering plate angular orientation adjustment means.

Wheel sets 7 and 9 are disposed at opposite ends of platform 1 and are comprised of ground engaging wheels 11 and transversely extending axles 13. Axles 13 are bolted to respective axle plates 15 preferably by means of nuts 17, bolts 18 and fittings 19, shown to best advantage in FIGS. 7 and 8. Fittings 19 allow bolts 18 to securely hold axles 13 against axle plates 15 by providing a transition element having a curved surface 19*a* interfacing with the curved surface of the axle 13 and a flat surface 19*b* interfacing with the axle plate or nut 17. FIGS. 1, 7 and 8 also show steering plates 21 fixed to cylindrical beams 23, preferably by nuts 24 and bolts 25 and fittings 27. Similarly to fittings 19, fittings 27 allow bolts 25 to securely hold beams 23 against steering plates 21 by providing a transition element having a curved surface 27*a* interfacing with the curved surface of the beam 23 and a flat surface 27*b* interfacing with the steering plate or nut 24. Steering plates 21 extend in parallel to axle plates 15 and have respective horizontally extending axes 8 extending perpendicularly to long axis 3 and parallel to planar support surface 5. Projecting from steering plate 21 is a pivot means, preferably bolt 37 as shown most clearly in FIGS. 7 and 8. Pivot means 37 joins axle plates 15 pivotally to respective steering plates 21, and the axle plates are retained to the steering plates by nut 36. Pivot means 37 allows platform 1 to tilt about long axis 3 as illustrated by phantom lines 39 in FIG. 5.

Figure 2:
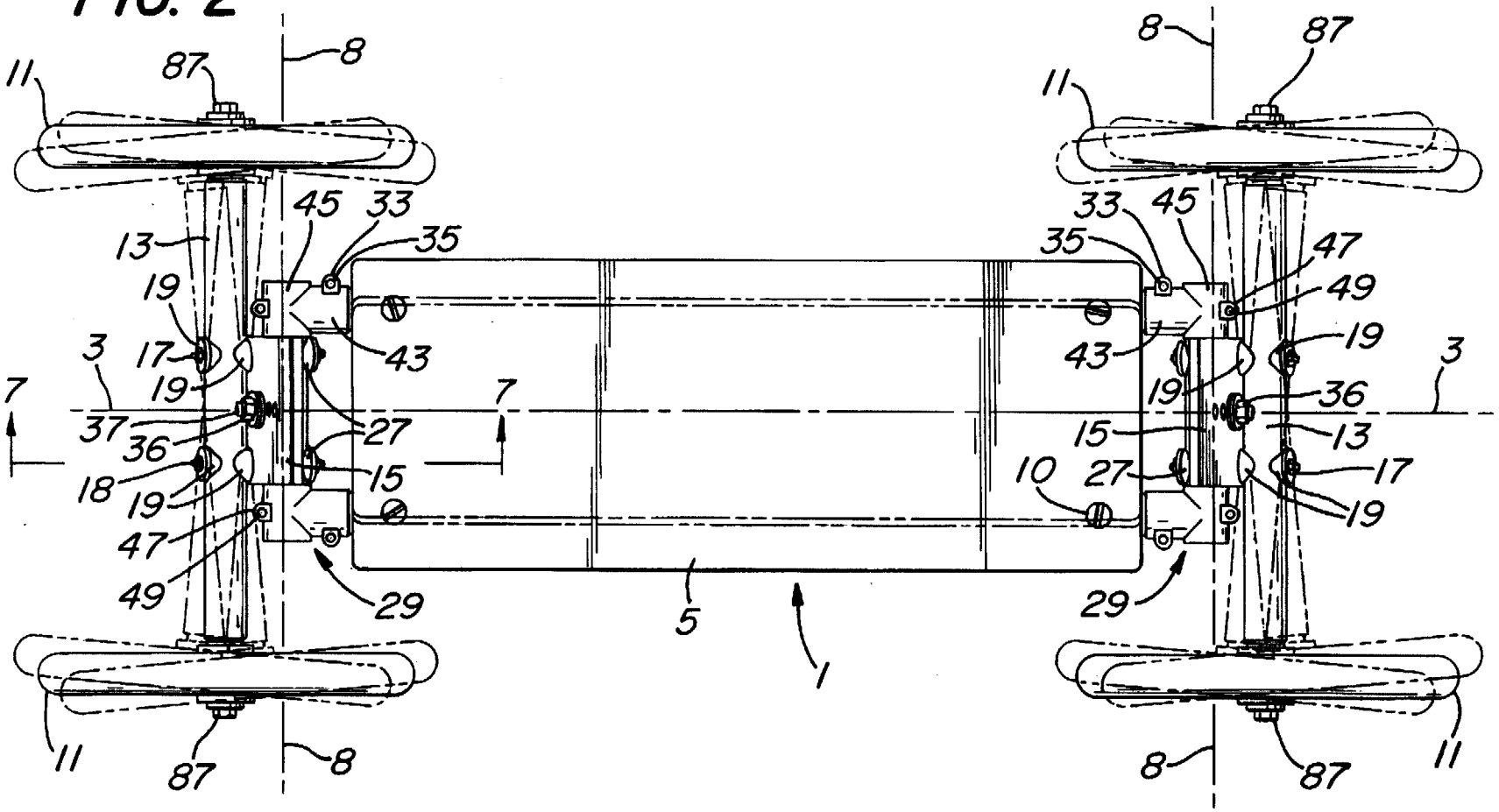
FIG. 2 shows a plan view of the mountain board of FIG. 1.
Figure 3:
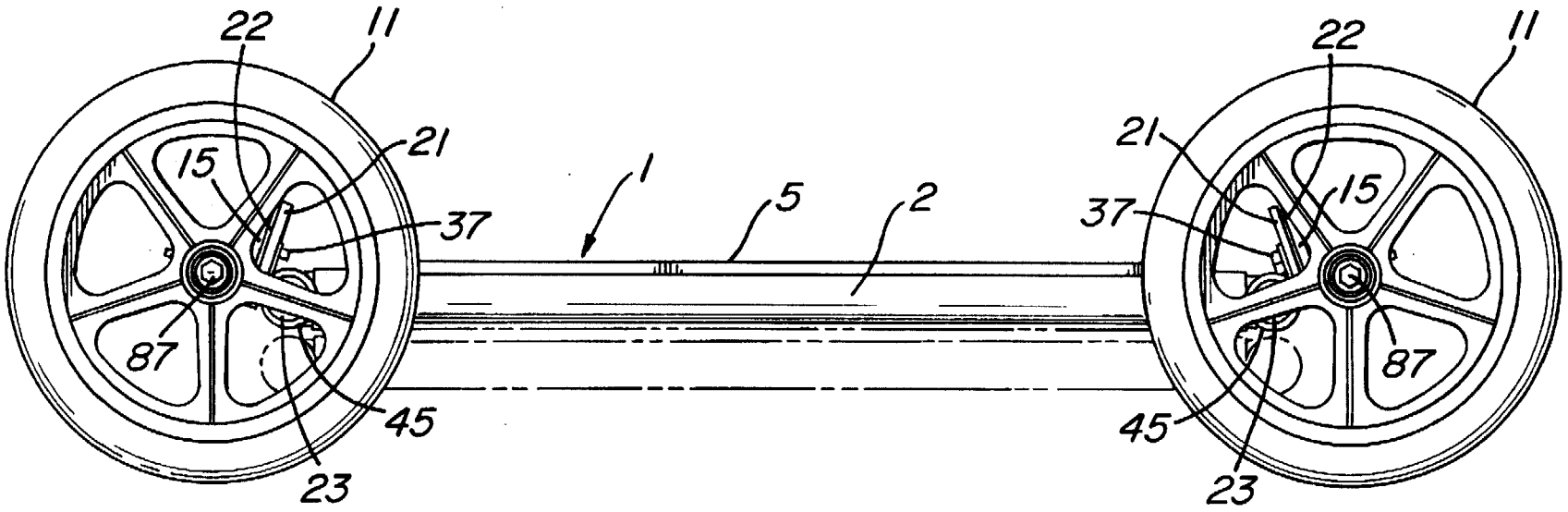
FIG. 3 shows a side view of the mountain board of FIGS. 1 and 2.

When platform 1 tilts on pivot means 37 about long axis 3 in response to a rider shifting his weight, steering plates 21 pivot in a plane parallel to axle plates 15 and impart steering forces to their respective axle plates 15, causing axles 13 to turn effecting a steering function, as shown in phantom in FIG. 2. As shown at 41 in FIGS. 7 and 8, steering plates 21 are angularly oriented relatively to the long axis 3 at an angle other than 90°. The magnitude of angle 41 between steering plate 21 and long axis 3 determines the steering sensitivity of the steering means. An acute angle, as shown at 41, causes steering forces which turn the mountain board toward the side of the mountain board which tilts downwardly. Thus, to turn to the left, a rider would shift his weight to the left, causing the left side of the mountain board to tilt downwardly. If steering plate 21 were oriented at an obtuse angle relatively to long axis 3, tilting the platform would cause steering forces which would turn the platform in the opposite direction to the side of the platform which tilts downwardly. Thus, to turn to the left, a rider would shift his weight to the right, causing the right side of the mountain board to tilt downwardly. If steering plate 21 were oriented at a 90° angle relatively to long axis 3, no steering forces would be produced by platform tilt.

Figure 5:
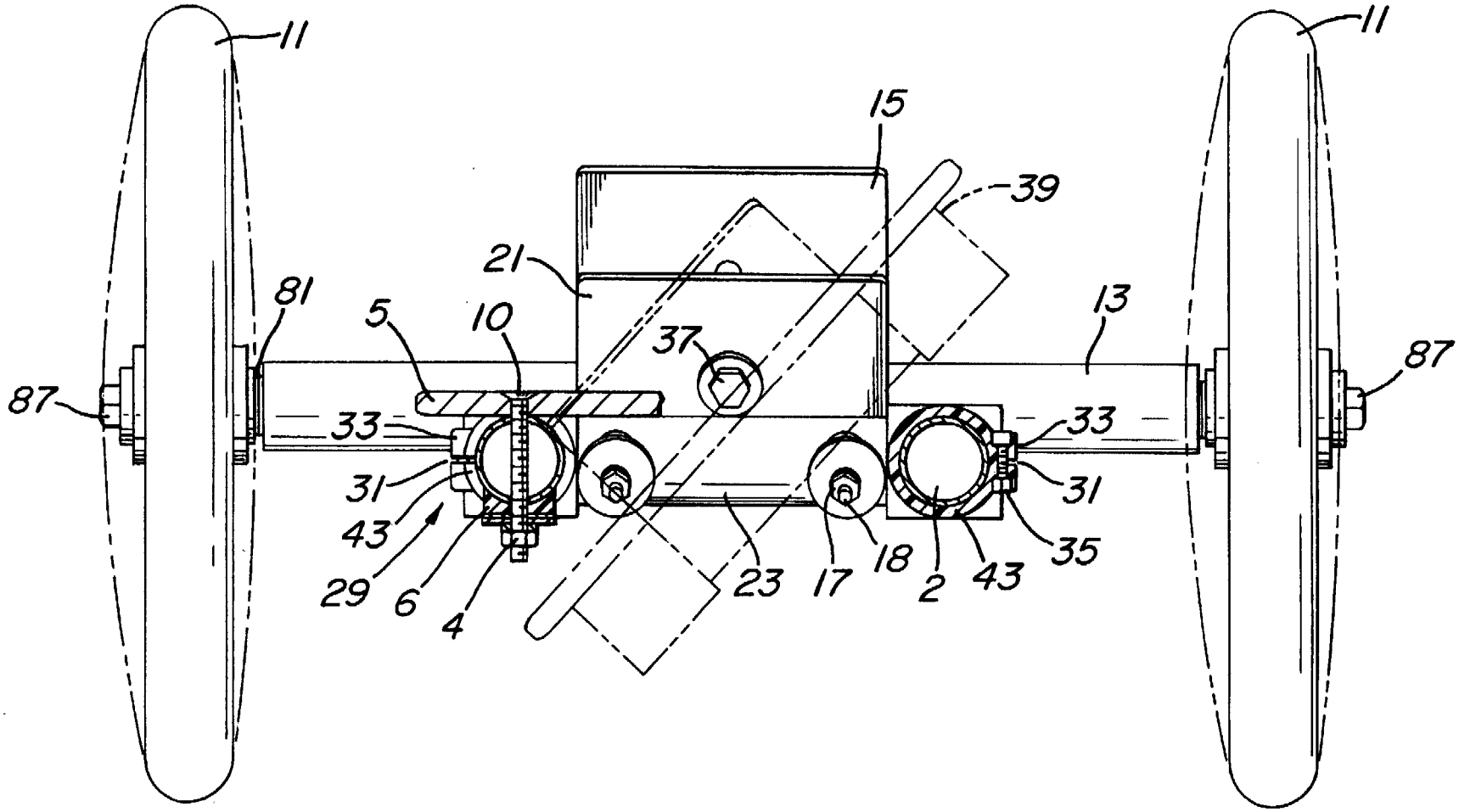
FIG. 5 is a sectional view, on the same scale as FIG. 4, taken along line 5—5 of FIG. 2 showing platform tilt and wheel steering motion in phantom line.

Horizontally extending beams 23 are preferably attached to platform 1 by "tee" fittings 29 which join longitudinal tubes 2 and beams 23 at right angles. Tee fittings 29 each have a socket 43 and a collar 45 as shown in FIG. 2. Sockets 43 engage longitudinal tubes 2 and collars 45 engage cylindrical beams 23. Sockets 43 are split, as shown in FIG. 5 at 31 and have side flanges 33 housing means for clamping tee fittings 29 to the ends of longitudinal tubes 2. Preferably, the clamping means is an allen screw 35 engaging the side flanges 33 and is readily tightened or loosened to afford rapid assembly and disassembly of the wheel sets 7 and 9, axle plates 15 and steering plates 21 to and from the platform 1.

FIG. 7 shows steering plate 21 extending upwardly from platform 1 and engaging axle plate 15, also extending upwardly, but from axle 13. Note that platform 1 is suspended below axle 13. The relative positioning of platform 1 below axle 13 provides inherent stability to the platform 1, a desirable characteristic for the mountain board. A washer 22 made of ultra high molecular weight polyester or other low friction material, such as PTFE, is preferably interposed between axle plate 15 and steering plate 21. Washer 22 prevents metal to metal contact and reduces friction between the plates. To further reduce friction, the facing surfaces of the plates may be slightly conical so that contact with the faces of the washer is substantially at the outer edges.

FIG. 8 shows a modified embodiment of the steering plate and axle plate configuration, with axle plate 15 extending downwardly from axle 13 and steering plate 21 extending upwardly from platform 1. This embodiment can provide even more stability to platform 1 as this configuration allows platform 1 to be suspended at a greater distance beneath axle 13 than is possible in the embodiment shown in FIG. 7.

Because the angular orientation 41 of steering plates 21 controls the steering sensitivity of the mountain board, it is preferable to provide means for adjusting the angular orientation of steering plates 21. In the embodiments shown in FIGS. 1–5, 7 and 8, the angular adjustment means is provided by the tee fittings 29 and cylindrical beams 23. Collars 45 engaging beams 23 are split similarly to sockets 43. Collars 45 further have side flanges 47 housing locking means, preferably an allen screw 49 engaging the side flanges 47. Collars 45 engage beams 23, and beam 23 can rotate within collars 45 about horizontally extending axis 8 perpendicular to the long axis 3. Rotation of beam 23 also rotates attached steering plate 21. Locking or stop means comprising allen screw 49 arrests or limits the rotation of beam 23 at a predetermined angle 41 when the screw 49 is tightened causing the split collar 45 to clamp down on the beam 23.

Figure 9:
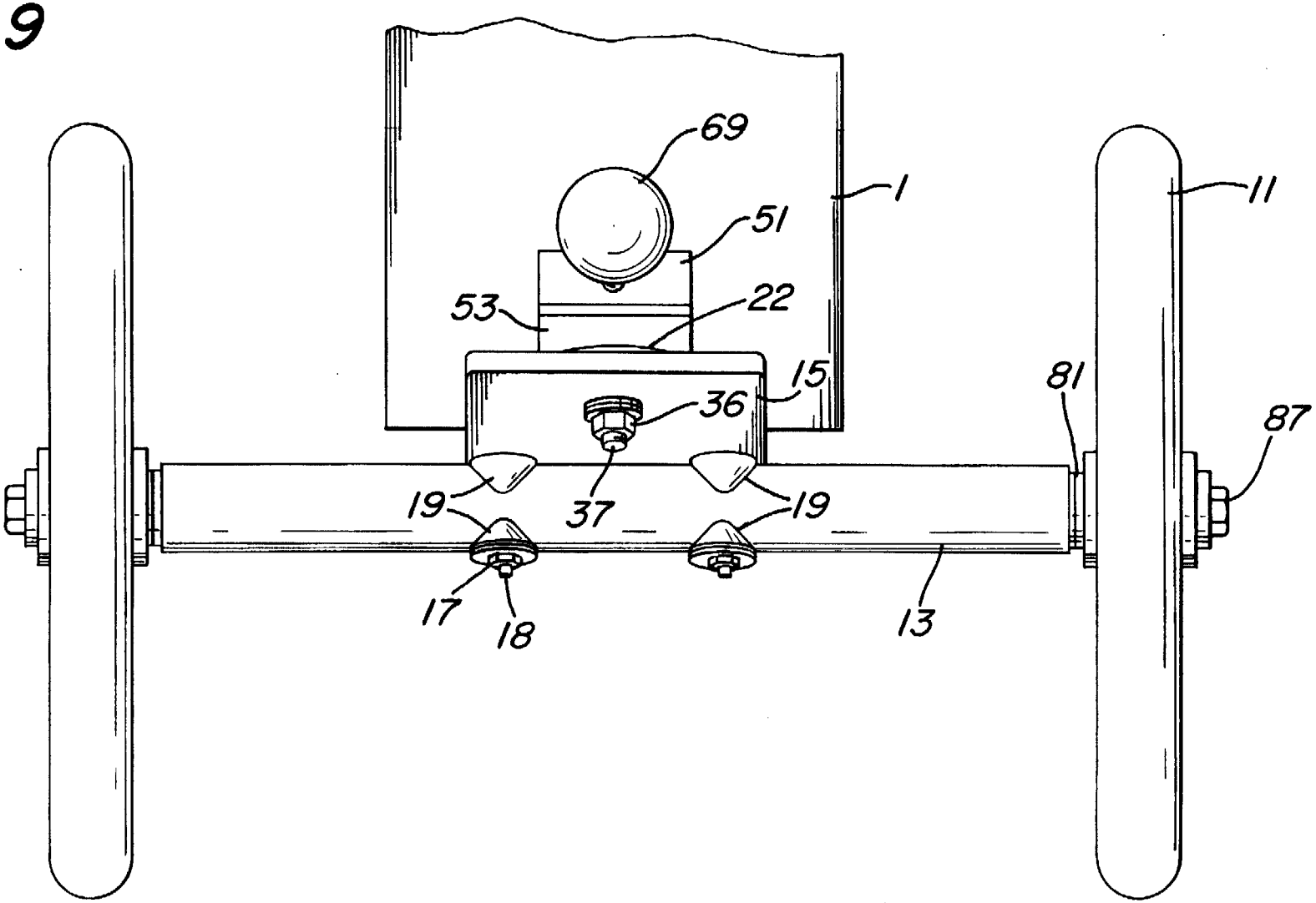
FIG. 9 shows a partial plan view of an alternative embodiment of the mountain board.
Figure 10:
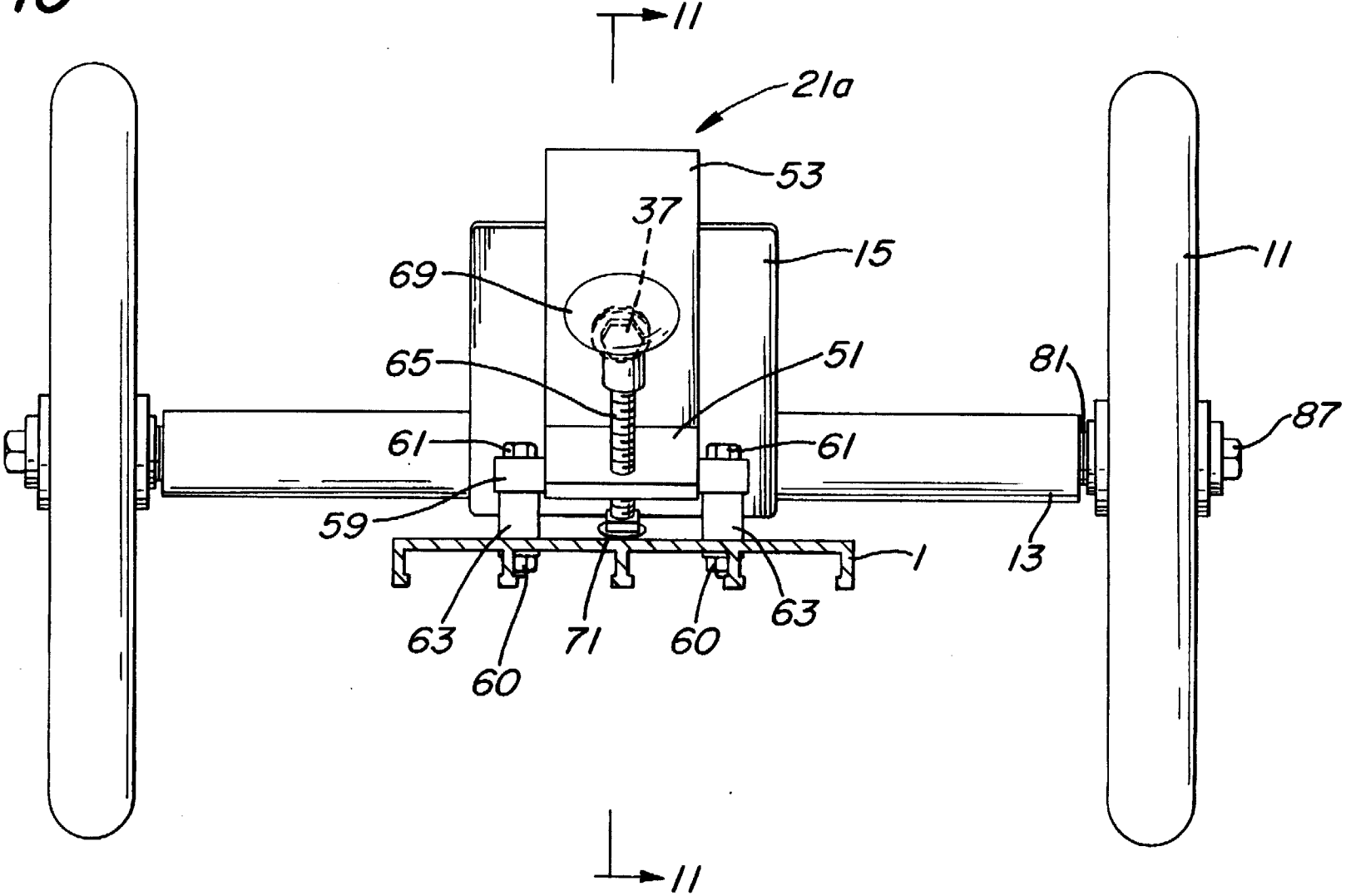
FIG. 10 shows a sectional view of an alternative embodiment of the mountain board along line 10—10 of FIG. 9.
Figure 11:
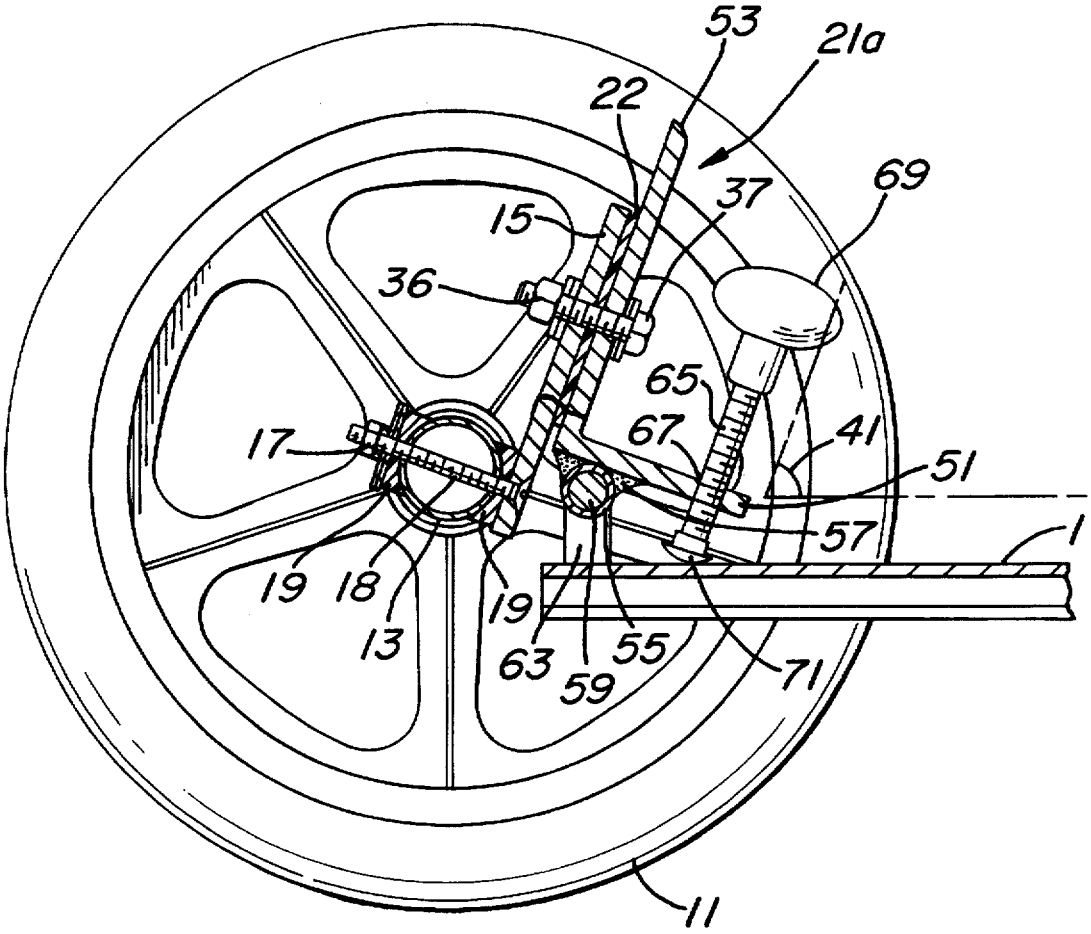
FIG. 11 shows a sectional view along line 11—11 of FIG. 10 showing an alternative embodiment of a steering plate angular adjustment means.

An alternative embodiment for adjusting the angular orientation 41 of the steering plates 21*a* is shown in FIGS. 9, 10 and 11. Steering plate 21*a* is comprised of first planar portion 51 and second planar portion 53 which are angularly joined. Pivot means, comprising bolt 37 projects from the surface of second planar portion 53 and pivotally engages axle plate 15. First planar portion 51 mounts bearing sleeve 55, preferably by weldment 57. Bearing sleeve 55 rotatably engages shaft 59, which is fixed to platform 1, preferably by nuts 60, bolts 61 and spacer stumps 63.

Preferably, angular orientation 41 of steering plate 21*a* is adjusted by jackscrew 65. Jackscrew 65 preferably engages threaded hole 67 in first planar portion 51 and advances or retreats through threaded hole 67 via screw action when torque is applied turning the jackscrew, preferably by hand knob 69 fixed to one end of the jackscrew. End butt 71, attached to the opposite end of jackscrew 65, engages platform 1, pushing against the platform when torque is applied to the jackscrew, causing steering plate 21*a* to rotate about shaft 59 on bearing sleeve 55. Jackscrew 65 permits the rider to impart a predetermined rotational displacement to steering plate 21*a*, thereby adjusting the angular orientation 41 of steering plate 21*a*.

Figure 4:
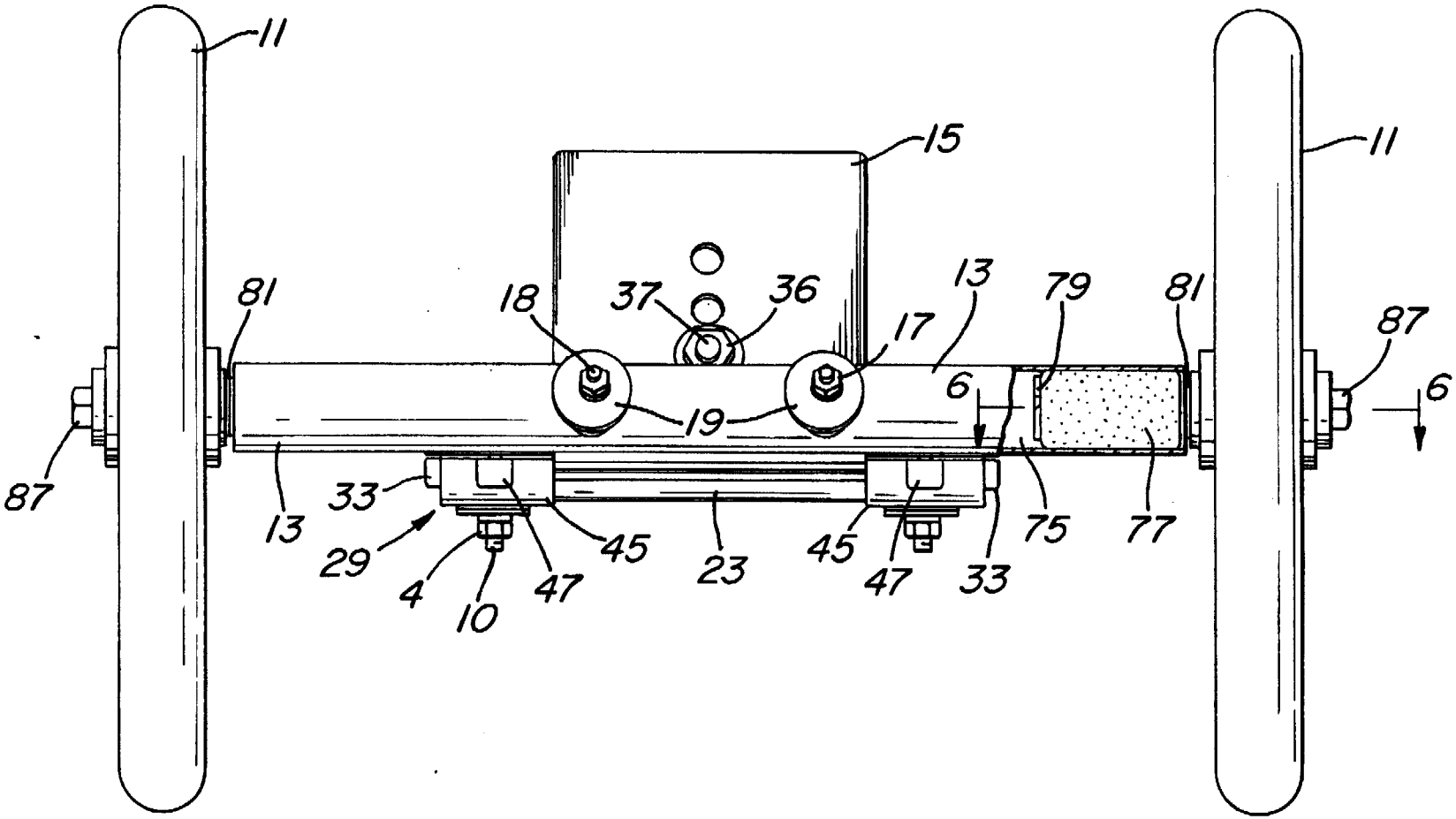
FIG. 4 shows an end view of the mountain board on an enlarged scale with respect to FIGS. 1–3 with a cutaway view of a preferred embodiment of wheel mounting.
Figure 6:
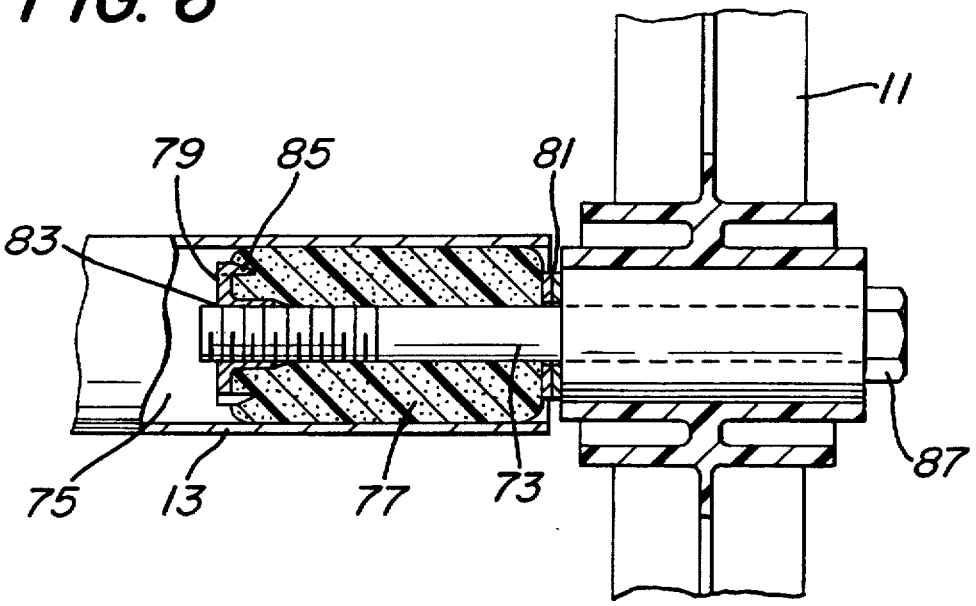
FIG. 6 is an enlarged sectional detail taken along line 6—6 of FIG. 4 showing an alternative embodiment of wheel mounting.
Figure 12:
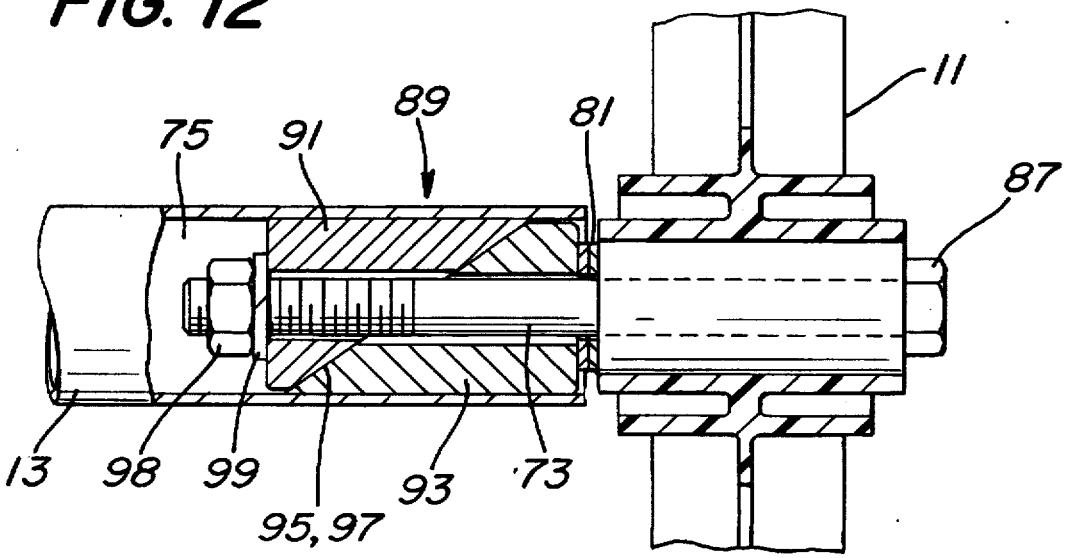
FIG. 12 shows a detailed sectional view of an alternative embodiment of wheel mounting.

FIGS. 4, 6 and 12 illustrate two means for mounting wheel 11 to axle 13. In an embodiment of wheel mounting shown in FIG. 6, wheel 11 rotatably engages wheel retaining shaft 73 which is coaxially arranged within recess 75 at an end of axle 13. Cylindrical annular bushing 77 is also arranged coaxially within recess 75, engaging both retaining shaft 73 and axle 13. Bushing 77 is made of a compressible resilient material, such as ethylene-propylene-diene rubber (EPDM), and is engaged between compression plate 79 and washer pair 81. Compression plate 79 has a threaded hole 83 which engages mating threads on retaining shaft 73 and projections 85 which grip bushing 77. When torque is applied in one direction to head 87 of retaining shaft 73, screw action axially compresses bushing 77 between compression plate 79, washer pair 81 and wheel 11. Projections 85 prevent compression plate 79 from turning with retaining shaft 73. The axial compression causes bushing 77 to expand radially outwardly and apply pressure to recess 75 of axle 13. Friction forces between bushing 77 and axle 13 develop as a result of the pressure and retain wheel 11 to axle 13.

In an alternative embodiment of wheel mounting shown in FIG. 12, compressible bushing 77 is replaced by bushing 89 which is made of a relatively incompressible material. Bushing 89 is split into bushing halves lengthwise forming wedges 91 and 93 which mutually interengage along inclined surfaces 95 and 97. Torque applied to retaining shaft head 87 causes bushing 89 to be axially compressed between retaining nut 98 and washer 99, washer pair 81 and wheel 11. Bushing halves 91 and 93 ride up inclined surfaces 95 and 97 under the axial compressive forces and wedge within recess 75 of axle 13, wheel 11 being retained to axle 13 by the wedging action.

In use, the mountain board is easily transported disassembled, fitting conveniently in the trunk of an automobile. Once at the site of intended use, for example, a park having hilly terrain or a beach with dunes, the mountain board can be quickly assembled with simple hand tools. Wheel retaining shafts 73 are inserted into wheels 11, washer pair 81 and then into bushings 77 or alternatively bushings 89. Compression plates 79 are then used in conjunction with compressible bushings 77 to retain the bushings to the retaining shafts 73. Likewise, retaining nuts 98 are used to retain bushings 89 to retaining shafts 73 if the split bushing version of wheel mounting is used. Retaining shafts 73 are then inserted into recesses 75 of axles 13 and torque is applied to shaft heads 87, causing the wheels to be retained to axles 13 as described in detail above. Axles 13 with mounted wheels 11 form wheel sets 7 and 9. Preferably, axle plates 15 are already attached to axles 13 and generally need not be removed from the axles during disassembly for transport.

Preferably, beams 23 are also already attached to steering plates 21, there being no need to disassemble these for transport either. The ends of beams 23 are next inserted into their respective collars 45 in tee fittings 29, two tee fittings per beam. Tee fittings 29 with beams 23 are next mounted on the ends of longitudinal tubes 2 via sockets 43. Preferably, planar surface 5 is already attached to tubes 2, there being no need to disassemble tubes 2 from planar surface 5 for transport. Next, allen screws 35 are tightened, clamping tee fittings 29 to longitudinal tubes 2. The angular orientation 41 of steering plates 21 may next be set and the plates 21 locked into place by tightening allen screws 49, thereby arresting the rotation of beams 23.

Steering plates 21 are next aligned in overlapping relationship with their respective axle plates 15, and washer 22 is interposed between the plates. Bolts 37 and mating nuts 36 are used to pivotally mount axles plates 15 to steering plates 21. With this final step, the mountain board is ready for use.

The mountain board may be ridden over rough terrain with its large diameter pneumatic wheels 11 providing adequate ground clearance and cushioning against bumps and ruts. A rider can easily slalom down a hill on the board or follow a marked trail, shifting his weight to tilt the platform 1 to turn left and right, adequate ground clearance being maintained by the large wheels 11 even when the platform is tilted to steer the board. The rider may adjust the steering sensitivity to his liking by loosening allen screws 49 and changing the angle 41 of steering plates 21, by rotating beams 23 with attached steering plates 21 toward 90° to lessen the degree of axle steering rotation for a given platform tilt angle or toward zero degrees to increase the degree of axle steering rotation for a given angle of platform tilt. The allen screws 49 must of course be tightened again to lock the angle of steering plates 21 at the desired angle.

The inherent stability afforded by the platform 1 suspended beneath the axles 13 further ensures adequate control over the mountain board. The rider may choose to operate the mountain board in either of the configurations shown in FIGS. 7 and 8, depending upon the type of terrain encountered. For example, the configuration of FIG. 7, with both the steering plate and the axle plate extending upwardly, provides more ground clearance for operating the mountain board on rough terrain and more clearance between a rider and the wheels, advantageous for making tight turns wherein the wheels may otherwise brush against the rider and limit the turn radius. The configuration shown in FIG. 8 on the other hand, with the steering plate extending upwardly and the axle plate extending downwardly, provides the rider with increased stability and a more solid feel to the board, which may be preferable for a rider just learning how to control the mountain board or for an experienced rider operating on extremely rough terrain. The rider effects the conversion by simply flipping the board over on its wheels and then rotating the platform through 180 degrees on the pivoting means. This feature marks the mountain board as uniquely versatile compared with other riding boards, such as skateboards, which do not have any such feature and are strictly limited to a single configuration by their construction. Note that this convertibility feature is common to the mountain board embodied in FIG. 11 as well, the conversion effected with equal ease and in the same manner as for the embodiment shown in FIGS. 7 and 8.

On relatively flat terrain, the mountain board can be propelled in the manner of a scooter or skateboard with the rider pushing against the ground with one foot while the other foot is on the planar surface 5.

If the alternative embodiment of the mountain board shown in FIG. 11 is used, assembly of the mountain board proceeds much as outlined above, with the exception that bearing sleeves 55 on steering plates **21*a* slip over respective shafts 59 which are in turn bolted to platform 1 via bolts 61, nuts 60 and spacer stumps 63, as seen in FIGS. 10 and 11. Axle plate 15 is pivotally mounted on second planar portion 53 of steering plate 21*a* by bolt 37 and retained by nut 36, washer 22 being interposed between the plates. The steering plate angle 41 may be adjusted by turning jackscrew 65 with hand knob 69. The jackscrew advances or retreats through threaded hole 67 in first planar portion 51 of steering plate 21*a*. End butt 71 engages platform 1 and causes steering plate 21*a* to rotate on shaft 59, allowing steering plate angle 41** to be conveniently adjusted to suit the rider, providing greater or lesser steering sensitivity.

I claim:

1. A steerable wheeled riding board, comprising:

an elongated platform having a planar support surface for support of a rider of the board, said platform being tiltable about its long axis;

first and second wheel sets having ground engaging wheels, said wheel sets being disposed at opposite ends of said platform, said wheel sets having first and second axles respectively extended transversely of said long axis, said ground engaging wheels being rotatably mounted on said axles;

a first steering means for imparting a steering motion to said first wheel set in accordance with tilting motions of said platform about said long axis, said first steering means comprising a first steering plate mounted on said platform adjacent to said first wheel set, said first steering plate having a first horizontally extending axis extending perpendicularly to said long axis and parallel to said planar support surface, said first steering plate being disposed about said first horizontally extending axis at an angular orientation other than 90° to said long axis;

a first axle plate fixed to said first axle and extended parallel thereto, said first axle plate being extended parallel to and in overlapping relationship with said first steering plate; and first pivot means pivotally interconnecting said first steering plate and said first axle plate for imparting steering motion to said first axle in accordance with tilting motions of said platform imparted in response to shifting of the weight of the rider relatively to said long axis.

2. A steerable wheeled riding board according to claim 1 further comprising a first means for adjusting the angular orientation of said first steering plate about said first horizontally extending axis.

3. A steerable wheeled riding board according to claim 2 in which said first adjusting means comprises:

first rotational means for mounting said first steering plate for rotation about said first horizontally extending axis; and first stop means for limiting said angular orientation of said first steering plate to a predetermined angle about said first horizontally extending axis relatively to said platform.

4. A steerable wheeled riding board according to claim 2 in which said first adjusting means comprises:

first rotational means for mounting said first steering plate for rotation about said first horizontally extending axis; and first means for imparting a predetermined rotational displacement of said first steering plate about said first horizontally extending axis, said first imparting means being presettable to limit said rotational displacement at a predetermined angle about said first horizontally extending axis.

5. A steerable wheeled riding board according to claim 2 in which said first adjusting means comprises:

a first elongated cylindrical beam fixedly mounting said first steering plate, said first beam being disposed adjacent to said first wheel set, said first beam extending horizontally transversely of said long axis;

a first collar fixed to said platform adjacent to said first wheel set, said beam being rotatable within said first collar about an axis perpendicular to said long axis;

a first locking means for arresting angular rotation of said first beam relative to said first collar thereby adjusting said angular orientation of said first steering plate.

6. A steerable wheeled riding board according to claim 2 in which said first adjusting means comprises:

a first shaft fixedly mounted on said platform adjacent to said first wheel set, the rotational axis of said first shaft extending horizontally and transversely of said long axis;

a first bearing sleeve rotatably engaging said first shaft, said first bearing sleeve fixedly mounting said first steering plate, said first steering plate comprising first and second planar portions angularly joined, said first planar portion being fixedly attached to said first bearing sleeve and extending adjacent to said platform, said second planar portion extending away from said platform, said second planar portion pivotally engaging said first axle plate;

first means adjustably connected to said first planar portion and engaging said platform for forcing said first steering plate to rotate on said first shaft whereby said angular orientation of said first steering plate is adjusted.

7. A steerable wheeled riding board according to claim 2 further including:

a second steering means for imparting a steering motion to said second wheel set in accordance with tilting motions of said platform about said long axis, said second steering means comprising a second steering plate mounted on said platform adjacent to said second wheel set, said second steering plate having a second horizontally extending axis extending perpendicularly to said long axis and parallel to said planar support surface, said second steering plate being disposed about said second horizontally extending axis on said platform, at an angular orientation other than 90° to said long axis;

a second axle plate fixed to said second axle and extending parallel thereto, said second axle plate being extended parallel to and in overlapping relationship with said second steering plate; and second pivot means pivotally interconnecting said second steering plate and said second axle plate for imparting steering motion to said second axle in accordance with tilting motions of said platform imparted in response to shifting of the weight of the rider relatively to said long axis.

8. A steerable wheeled riding board according to claim 7 shaving a second means for adjusting said angular orientation of said second steering plate about said second horizontally extending axis.

9. A steerable wheeled riding board according to claim 8 wherein said first and second steering plates are suspended on said first and second pivot means respectively and said platform is positioned below said first and second pivot means.

10. A steerable wheeled riding board according to claim 9 in which said first and second axle plates extend relatively downwardly from said first and second axles respectively, said first and second steering plates extend relatively upwardly from said platform, said first and second pivot means pivotally interconnecting said first steering plate and said first axle plate and said second steering plate and said second axle plate at respective points intermediate the platform and the first and second axles respectively.

11. A steerable wheeled riding board according to claim 12 in which said first and second wheel sets have two pairs of said ground engaging wheels rotatably mounted on said first and second axles, one wheel being mounted at each end of said first and second axles.

12. A steerable wheeled riding board according to claim 8 in which said second adjusting means comprises:

second rotational means for mounting said second steering plate for rotation about said second horizontally extending axis; and second stop means for fixing said angular orientation of said second steering plate at a predetermined angle about said second horizontally extending axis.

13. A steerable wheeled riding board according to claim 8 in which said second adjusting means comprises:

a second elongated cylindrical beam fixedly mounting said second steering plate respectively, said second beam being disposed adjacent to said second wheel set, said second beam extending horizontally transversely of said long axis;

a second collar fixed to said platform adjacent to said second wheel set, said second beam being rotatable within said second collar about an axis perpendicular to said long axis;

a second locking means for arresting angular rotation of said second beam relative to said second collar thereby adjusting said angular orientation of said second steering plate.

14. A steerable wheeled riding board according to claim 8 in which said second adjusting means comprises:

a second shaft fixedly mounted on said platform adjacent to said second wheel set, the rotational axis of said second shaft extending horizontally and transversely of said long axis;

a second bearing sleeve rotatably engaging said second shaft, said second bearing sleeve fixedly mounting said second steering plate, said second steering plate comprising third and fourth planar portions angularly joined, said third planar portion being fixedly attached to said second bearing sleeve and extending adjacent to said platform, said fourth planar portion extending away from said platform, said fourth planar portion pivotally engaging said second axle plate;

second means adjustably connected to said third planar portion and engaging said platform for forcing said second steering plate to rotate on said second bearing whereby said angular orientation of said second steering plate is adjusted.

15. A steerable wheeled riding board according to claim 1 wherein said first steering plate is suspended on said first pivot means and said platform is positioned below said first pivot means.

16. A steerable wheeled riding board according to claim 15 in which said first axle plate extends relatively downwardly from said first axle, said first steering plate extends relatively upwardly from said platform, and said first pivot means pivotally interconnects said first steering plate and said first axle plate at a point intermediate the platform and the first axle.

17. A steerable wheeled riding board according to claim 1 in which said first wheel set comprises a first pair of rotatably mounted ground engaging wheels, said first ground engaging wheel pair being mounted on said first axle, one wheel on each end thereof.

18. A steerable wheeled riding board according to claim 17 in which said second wheel set comprises a second pair of rotatably mounted ground engaging wheels, said second ground engaging wheel pair being mounted on said second axle, one wheel on each end thereof.

19. A steerable wheeled riding board according to claim 18 having wheel mounting means for said ground engaging wheel pairs comprising:

said first and second axles each having first and second recesses at opposite ends thereof;

four wheel retaining shafts, each one aligned coaxially within one of said first and second recesses of said first and second axles;

said first and second ground engaging wheel pairs rotatably mounted on said retaining shafts, one wheel per shaft;

frictional means arranged respectively within each of said first and second recesses of said first and second axles, said frictional means fixed respectively to each said retaining shafts;

means for outwardly expanding said frictional means to engage said axle recesses, frictional forces between said frictional means and said axle retaining said shafts within said axles.

20. A steerable wheeled riding board according to claim 19 in which:

said frictional means comprises four elongated cylindrical annular bushings, being of a relatively compressible resilient material, said bushings coaxially arranged respectively within said first and second recesses of said first and second axles; and said expanding means comprising means for axially compressing and thereby outwardly expanding said bushings to frictionally engage said axle recesses, frictional forces between said bushings and said axle retaining said retaining shafts within said axles.

21. A steerable wheeled riding board according to claim 19 in which:

said frictional means comprises four elongated cylindrical annular bushings mounted respectively within said first and second recesses of said first and second axles between said axles and said retaining shafts, said bushings each comprised of bushing halves forming wedges interengaging along inclined surfaces; and said means for outwardly expanding said frictional means comprising means for axially compressing said bushing halves against each other thereby causing said bushing halves to ride up said inclined surfaces and wedge within said axle recesses, retaining said shafts within said axles.

22. A steerable wheeled riding board according to claim 1 having means for readily attaching and removing said wheel sets respectively to and from said platform.

* * * * *

UNITED STATES PATENT AND TRADEMARK OFFICE

CERTIFICATE OF CORRECTION

PATENT NO. : 5,794,955
DATED : August 18, 1998
INVENTOR(S) : Flynn

It is certified that error appears in the above-identified patent and that said Letters Patent is hereby corrected as shown below:

On the title page, item [56], References Cited under U.S. Patent Documents, reference to "4,991,861 2/1991 Carn et al.", change the subclass from "280/87.092" to --280/87.042--.

Column 8, line 52, change "relatively" to -- relative--.

Column 9, line 53, change "relatively" to --relative--.

Column 10, line 8, change "12" to --10--

Signed and Sealed this

Twenty-fourth Day of November, 1998

*Attest:*

*Attesting Officer*

BRUCE LEHMAN

*Commissioner of Patents and Trademarks*